US007178688B2

(12) United States Patent
Naufel et al.

(10) Patent No.: US 7,178,688 B2
(45) Date of Patent: Feb. 20, 2007

(54) PORTABLE MEDICATION DISPENSER

(76) Inventors: Naji C. Naufel, 249 W. Manor Dr., Chesterfield, MO (US) 63017; Ghadir Naufel, 249 W. Manor Dr., Chesterfield, MO (US) 63017

( * ) Notice: Subject to any disclaimer, the term of this patent is extended or adjusted under 35 U.S.C. 154(b) by 152 days.

(21) Appl. No.: 10/337,762

(22) Filed: Jan. 7, 2003

(65) Prior Publication Data

US 2004/0129716 A1 Jul. 8, 2004

(51) Int. Cl.
*A47F 1/00* (2006.01)

(52) U.S. Cl. ..... 221/28; 221/93; 221/13

(58) Field of Classification Search ..... 221/2, 221/5, 9, 13, 25, 123, 88, 26, 28, 30, 93
See application file for complete search history.

(56) References Cited

U.S. PATENT DOCUMENTS 3,998,356 A 12/1976 Christensen
4,258,354 A * 3/1981 Carmon et al. ..... 340/309.4
4,267,942 A 5/1981 Wick, Jr. et al.
4,616,316 A 10/1986 Hanpeter et al.
4,674,652 A 6/1987 Aten et al.
4,763,810 A * 8/1988 Christiansen ..... 221/3
4,847,764 A 7/1989 Halvorson
5,047,948 A 9/1991 Turner
5,408,443 A 4/1995 Weinberger
5,609,268 A * 3/1997 Shaw ..... 221/2
5,752,621 A * 5/1998 Passamante ..... 221/13
5,810,198 A 9/1998 Townsend et al.
5,959,869 A * 9/1999 Miller et al. ..... 700/231
6,004,020 A * 12/1999 Bartur ..... 700/236
6,394,306 B1 * 5/2002 Pawlo et al. ..... 221/2
6,439,422 B1 * 8/2002 Papp et al. ..... 221/13
6,601,729 B1 * 8/2003 Papp ..... 221/25
6,702,146 B2 * 3/2004 Varis ..... 221/3

* cited by examiner

*Primary Examiner*—Gene O. Crawford
*Assistant Examiner*—Rashmi Sharma
(74) *Attorney, Agent, or Firm*—Pablo Meles; Akerman Senterfitt

(57) ABSTRACT

A medication dispensing system (10) includes a portable securable container (42), and a mechanism (12, 13, 14, 16, 19) for dispensing a dosage of solid medication. The system further comprises a processor (11) interfacing with the mechanism and further programmed to await (402) an authorization code from an authorized user among a plurality of authorized users, dispense (404) a dosage of medication while maintaining remaining dosages of medication secure in the portable secure dispenser upon receipt of at least the authorization code and optionally a patient's name, and store (406) a code representative of the authorized user, a code representative of the patient's name, and a date and time of dispensation of the dosage of medication in a memory.

10 Claims, 4 Drawing Sheets

PORTABLE MEDICATION DISPENSER

FIELD OF THE INVENTION

This invention relates generally to medication dispensers, and more particularly to portable medication dispensers providing auditing features.

BACKGROUND OF THE INVENTION

In many hospital and clinical situations narcotic medications need to be tightly controlled with a means for auditing the dispensation of such medications. In many instances Federal and State regulations require the date and time of dispensation registered to a particular patient's chart. The data logging activity by caregivers, hospital staff or even the patient's themselves often gets forgotten or inaccurately recorded. In some instances, the medicine is stolen making it impossible to account for every pill dispensed. Healthcare facilities have difficulty complying with Federal and State narcotic regulations under these conditions.

Existing products used by hospitals are large and expensive, typically one per floor, that attempt to solve at least part of the existing auditing problems. All controlled substances are placed in a plurality of compartments inside of the machine as stock medicine. Smaller facilities or clinics usually cannot afford such machines. These machines are not immune to theft since the pills of a particular medicine and/or dose are placed in one compartment, where the staff is entrusted to take only one.

Numerous dispensing machines exist and are described in the art. For example:

U.S. Pat. No. 4,616,316 to Hanpeter describes a medication compliance monitoring device which registers, in a microcomputer memory, the time a patient removed a dose from the blister pack to be evaluated by a physician.

U.S. Pat. No. 3,998,356 to Christensen describes an apparatus using a plurality of magazines, each containing a number of doses placed in rotatable compartments. The dispensing time is preprogrammed into the apparatus.

U.S. Pat. No. 4,267,942 to Wick Jr. et al. describes a pharmaceutical storage and dispensing cabinet. It provides the date and time of removal, and the identity of the recipient.

U.S. Pat. No. 5,810,198 to Townsend et al. describes a motorized tablet dispenser in which pills are placed in a rotating hopper.

U.S. Pat. No. 5,047,948 to Turner describes a portable device for dispensing medication to a patient in response to programmed signals entered within a control device.

U.S. Pat. No. 4,674,652 to Aten, et al. describes a medicine dispenser which alerts the patient to the times for dispensing and administering medication. Dispensing is allowed only in accordance with a predefined schedule and records the actual time of container dispensing.

U.S. Pat. No. 4,847,764 to Halvorson describes a system of dispensing medications in a healthcare institution where the pharmacy enters medication orders and a computer controls the dispensing of medications in remote medication dispensers.

U.S. Pat. No. 5,609,268 to Shaw describes an automatic pill dispensing apparatus having a plurality of cartridges supported in guide slots within a housing. The apparatus is integrated with a microprocessor operating according to an algorithm, which receives, stores and processes prescription schedule data. Each cartridge has a plurality of compartments disposed about its periphery for containing medication to be dispensed at proper intervals at a dispensing position. A dispense bar is manually actuated by the user to eject scheduled medication into a tray for user access. The plurality of cartridges enable filling by a pharmacist of independent multiple prescriptions. After the cabinet housing is loaded for use, the housing is locked to prevent access unless a security code is entered into the processor. A dislodging wire sweeps through each compartment as the dispense bar is depressed, thereby dislodging the medication from the compartment for user access.

U.S. Pat. No. 5,408,443 to Weinberger describes a medication-dispensing system including a prescribing data entry station for use by a physician to store prescription information in a portable prescribing module, a dispensing data entry station for use by a pharmacist to store dispensing information in a portable dispensing data storage unit, and a medication dispenser responsive to information stored in the portable prescribing module to describe use of medication in the dispenser in accordance with a regimen prescribed by the physician and to the dispensing data storage unit to control dispensing of the medication.

Although each of the systems described above provide some form of auditing and possibly some additional benefits for avoiding mistakes in dispensing double dosages, none of the solutions above provide adequate auditing features and reduce the liability points for tampering in a cost effective and portable manner. Thus, a need exists for a dispensing system that ensures compliance and reduces costs that insurance companies and federal agencies have to pay as a result of poor auditing and abusive dispensation.

SUMMARY OF THE INVENTION

In a first aspect of the present invention, a medication dispensing system, comprises a portable securable container, and a mechanism for dispensing a dosage of solid medication. The system further comprises a processor interfacing with the mechanism and further programmed to await an authorization code from an authorized user among a plurality of authorized users, dispense a dosage of medication while maintaining remaining dosages of medication secure in the portable secure dispenser upon receipt of at least the authorization code and optionally a patient's name, and store at least two among a code representative of the authorized user, a code representative of the patient's name, and a time of dispensation of the dosage of medication in a memory.

In a second aspect of the present invention, a method of dispensing medication from a portable secure dispenser, comprises the steps of awaiting an authorization code from an authorized user among a plurality of authorized users, dispensing a dosage of medication while maintaining remaining dosages of medication secure in the portable secure dispenser upon receipt of at least the authorization code and optionally a patient's name, and storing a code representative of the authorized user, a code representative of the patient's name, and a date and time of dispensation of the dosage of medication in a memory.

DETAILED DESCRIPTION OF THE DRAWINGS

Figure 1:
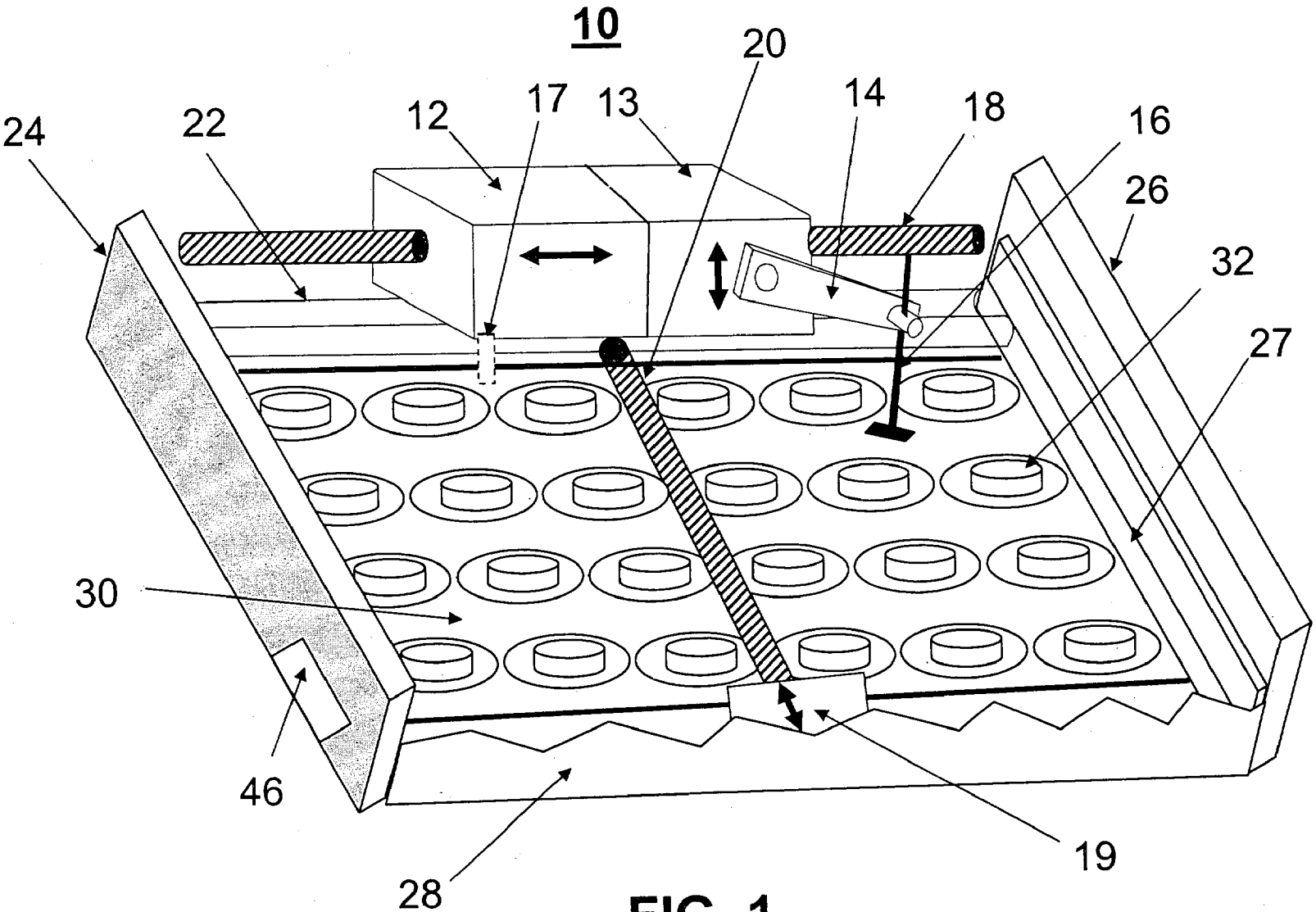
FIG. 1 is a perspective interior view of a dispensing system in accordance with the present invention.
Figure 2:
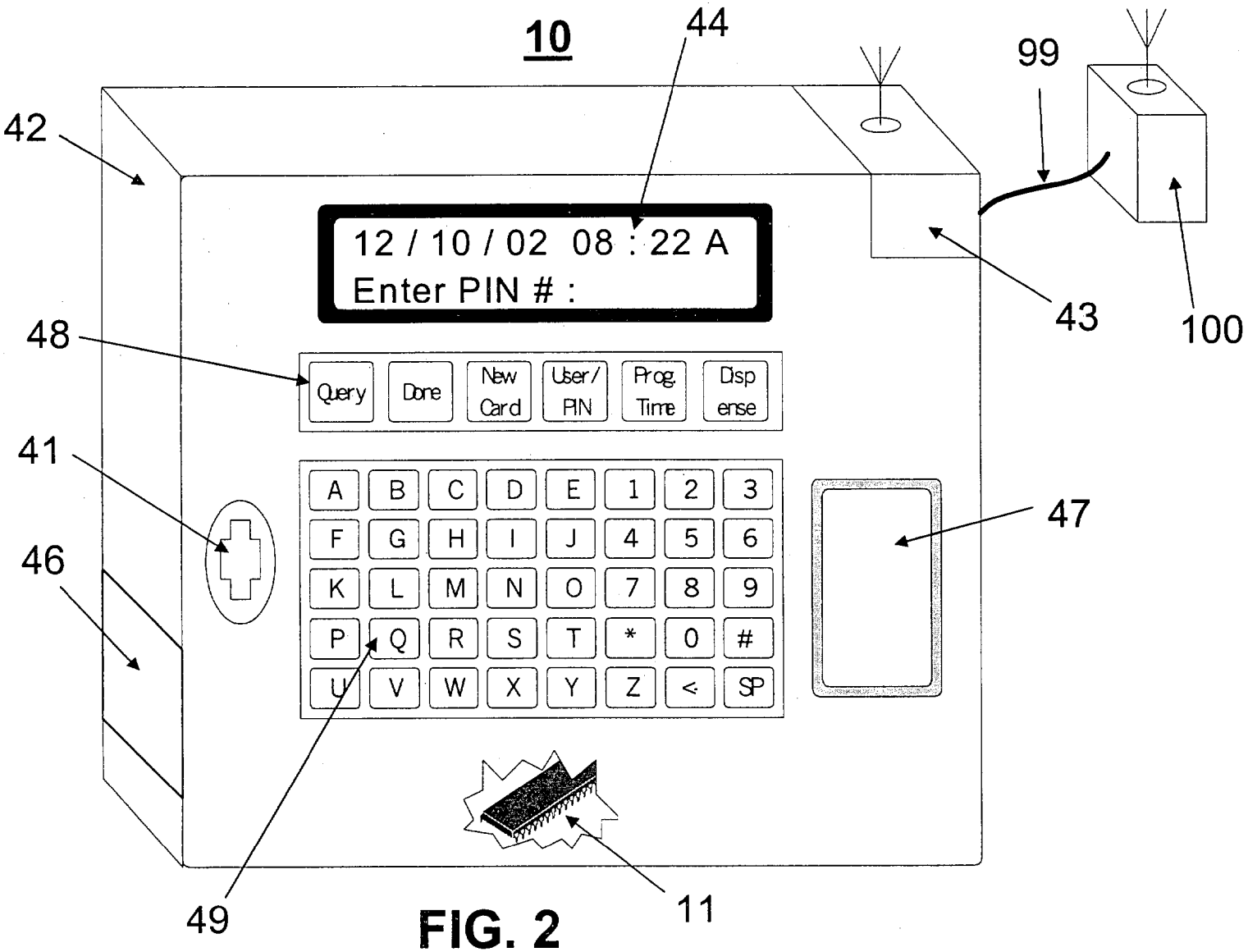
FIG. 2 is a perspective exterior view of the dispensing system of FIG. 1.

Referring to FIGS. 1 and 2, interior and exterior portions respectively of a medication dispensing system 10 are shown in accordance with the present invention.

The medication dispensing system 10 preferably comprises a portable securable container 42, a mechanism for dispensing a dosage of solid medication, and a processor 11 interfacing with the mechanism. The mechanism for dispensing can be embodied in many forms and one exemplary embodiment is shown to illustrate the concept although the present invention is not limited thereto. The mechanism for dispensing shown in FIG. 1 can comprise three (3) motors or actuators that enable a plunger unit (13, 14 and 16) to traverse a predetermined matrixed area and further enable to actuate the plunger 16 up and down to forcibly push a pill or a predetermined dosage or pills out of a blister pack or a bubble pack 32, preferably from a bubble pack card 30 having an array of blister or bubble packs 32. A first actuator or motor 12 enables the plunger unit to traverse back and forth across a first threaded bar 18. A second actuator or motor 19 enables the plunger unit to traverse a second threaded bar 20 (perpendicular to the first threaded bar 18). The actuator or motor 19 can be attached to a side wall 28 of the container or enclosure 42. The third actuator or motor 13 enables the up and down movement of an actuator arm 14 and attached plunger 16 to enable the actual dispensation of medicine from a blister or bubble pack as shown. The dispensing mechanism can further include a guide bar 22 attached to the plunger unit that aids in moving the plunger unit uniformly back and forth across threaded bars 18 and 20. Note that container or enclosure 42 may include side walls 24 and 26 which can further include grooves 27. Guide bar 22 can traverse within the grooves 27 as the plunger unit traverses back and forth across the threaded bar 20. Also note that guide bar 22 may also have a groove or trough that can aid in aligned movement of the plunger unit along threaded bar 18. In summary, the mechanism for dispensing can comprise a pair of perpendicularly mounted linear drive motors for placing an actuator motor adjacent to a single bubble pack. The actuator motor further comprises or is coupled to a plunger that pushes the dosage of solid medication out of the single bubble pack at the instruction of the authorized user. A dosage of solid medication should be understood to be a single pill or multiple pills or capsules or caplets that can be contained within a single bubble pack of a matrix of bubble packs in a bubble pack card. The present invention is ideally suited for bubble pack cards (typically 6 by 9 inches) provided or packaged by pharmacies for many healthcare provider institutions.

The processor 111 of system 10 is preferably programmed to await an authorization code from an authorized user among a plurality of authorized users as well as dispense a dosage of medication while maintaining remaining dosages of medication secure in the portable secure dispenser upon receipt of at least the authorization code and optionally a patient's name. The system 10 can then store a code representative of the authorized user, a code representative of the patient's name, and a date and time of dispensation of the dosage of medication in a memory. The code representative of the authorized user can be the name of the authorized user or a Personal Identification Number (PIN) of the authorized user and the code representative of the patient's name can be the patient's name or social security number for example. The processor can be further programmed to allow a user in an administrator mode to provide at least one among the functions of programming user names and authorization codes, setting a current date and time, dispensing a pill, resetting the system upon re-filling the system with a new bubble-pack card, displaying dispensation activity for a given authorized user or a given patient, programming the system for a unique patient or for stock medication dispensation, and upload dispensation activity data to a database on a computer. The system 10 can also include a locking mechanism 41 allowing an authorized administrator or supervisor to refill the dispenser accordingly. Note that the processor can respond to entries entered by keypad 48 for function commands, keypad 49 for alphanumeric entries, and optionally for biometric entries via a biometric entry device 47 that will register and track authorized users. Visual feedback and prompting can be achieved using a simple two-line liquid crystal display 44. The keypads, biometric entry device, and/or liquid crystal display would be coupled to the processor as is known in the art. The system may also include an easily accessible drawer 46 for retrieving the dosage of solid medication once it has been dispensed. Preferably the drawer or opening 46 can be on a portion of the sidewalls 24 or 26 or 28 of the enclosure 42. Of course, the system 10 can further include various ways of receiving and downloading dispensation data including a wireless means using a transmitter or a transceiver 43 as shown in FIG. 2. The transceiver's transmitter function can transmit dispensation data to a remote memory device 100, wherein dispensation data preferably comprises at least one among the code representative of the authorized user, the code representative of the patient's name, and the date and time of dispensation of the dosage of medication. Of course, the receiver function of the transceiver 43 can also receive updated dispensation data for a particular user. Alternatively, such data can be transferred conventionally using a wired link 99 as shown.

Figure 3:
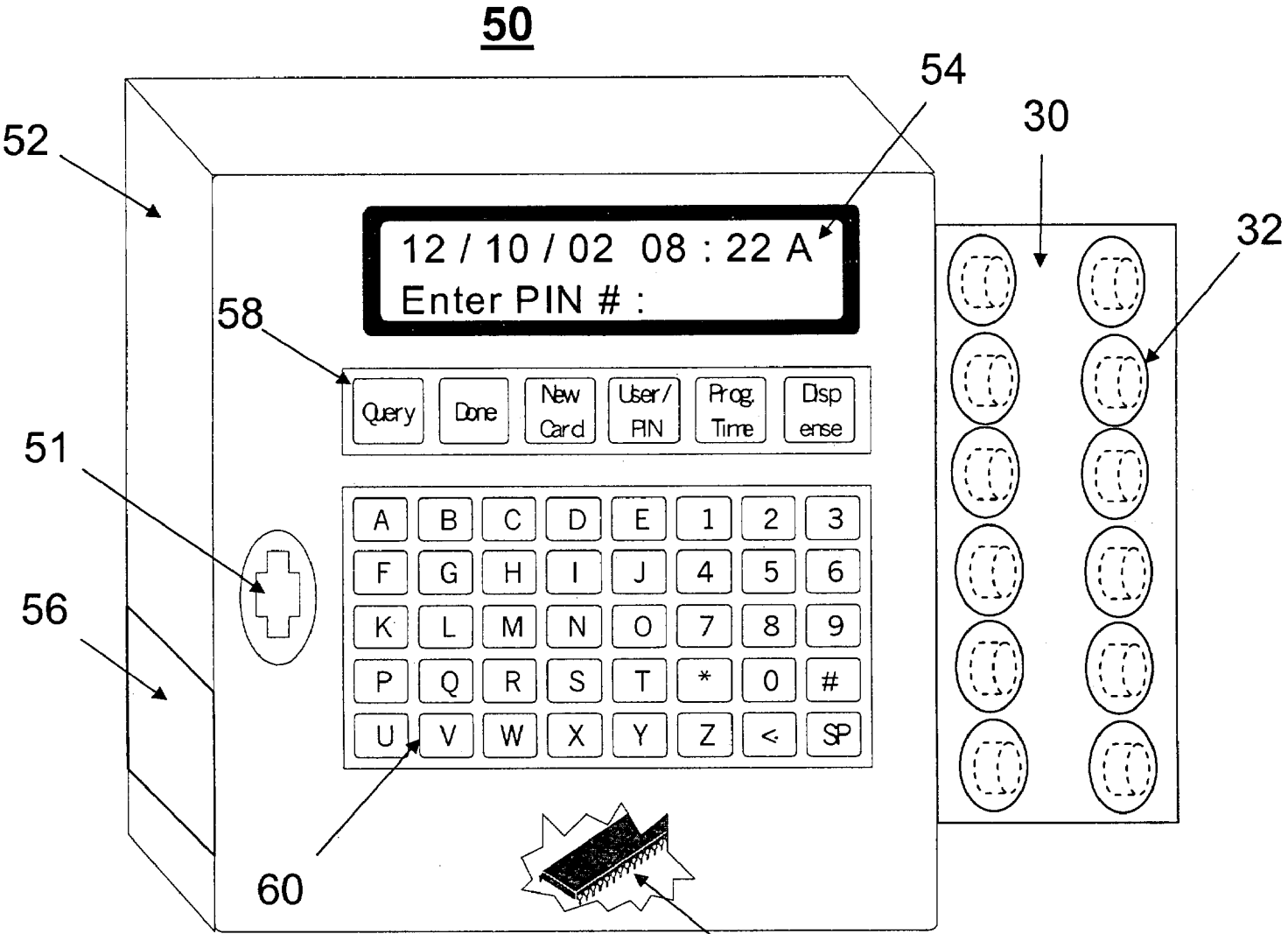
FIG. 3 is a perspective exterior view of an alternative dispensing system in accordance with the present invention.

Referring to FIG. 3, an alternative dispensing system 50 similar to dispensing system 10 is shown. As with dispensing system 10, dispensing system 50 can include an enclosure 52, display 54, access drawer or slot 56, keypads 58 and 60, locking mechanism 51, and a processor 61. In this embodiment, the bubble or blister pack card 30 is ejected from the enclosure 52 one row at a time after all the dosages on a row of bubble or blister packs 32 are dispensed. Internally, the system 50 can include similar components to those found in system 10 of FIG. 1, except that the bubble card 30 needs a mechanism for moving out. This can be achieved in several ways. For example, in FIG. 1, an optional connector 17 between the actuator 12 and the bubble card can move the card as the plunger unit moves towards the direction of wall 28. Alternatively, the system 50 can have a processor programmed to retain the plunger 16 in a down position at the end of dispensing a particular row as the plunger unit moves towards wall 28 along threaded member 20. Once the bubble card is shifted out for a row, the plunger 16 can be released and continue to operate as usual.

The present invention is ideally suited as a hand-held pill dispenser used to register pill dispensation activity, especially for controlled substances. Ideally, it can either hold a given patient's 30-day supply of medication in a standard 9×6 bubble-pack card, or a 30-day supply of stock medication, although the present invention is not necessarily limited to such configurations. The apparatus can provide a date and time stamp of the pill dispensation along with the operator's name and patient's name (if applicable) or other data as a particular caregiver may desire. This procedure ensures that the medicine dispensation gets logged properly for compliance and helps cut down on narcotic medication theft as well as inadvertent ingestion of excess dosages. The present invention differs from the large institutional dispensers used in hospitals in that it is hand-held or portable, economical and less prone to operator miscounting or theft. It can carry dosages dedicated to a unique or particular patient and can be left in the patient's room without much risk of tampering. Alternatively, the present invention can also be used with stock medication for use with multiple patients, cutting down on the waste of narcotics (unused narcotics prescribed to an individual must be destroyed if not used). Unlike the large machines which have to be filled and maintained by a pharmacy, an apparatus in accordance with the present invention is filled and maintained by facility staff since it can accept pre-packaged medication in a standard 9×6 punch card or bubble pack packaging, Medication remains locked and only dispenses one (1) dose without human handling of the pills until dispensed. Advantageously, the present invention uses original medication packaging from the pharmacy (9×6 bubble card) which is dispensed by the nursing staff or other authorized caretaker instead of the patient. Also, pills are automatically pushed out of the bubble pack without the user doing the work.

Operationally, the present invention can comprise of a portable securable compartment which can hold a standard 9×6 (inch) medicine card, two (2) motors to align the pill/tablet plunger over a pill, a 3rd motor or actuator to push the plunger onto the medicine card popping the pill/tablet out, a 2-line LCD display, a keyboard or other input device for data entry, and a processor or microcontroller circuit (MCU) containing non-volatile Flash memory for storage of operational data. The MCU can evaluate the keyboard entries or other inputs (biometric or otherwise) and upon a successful entry of an authorization code (4-digit PIN, for example), it can request a patient's name (if applicable). Then, the device proceeds to dispensing the pill/tablet.

Figure 4:
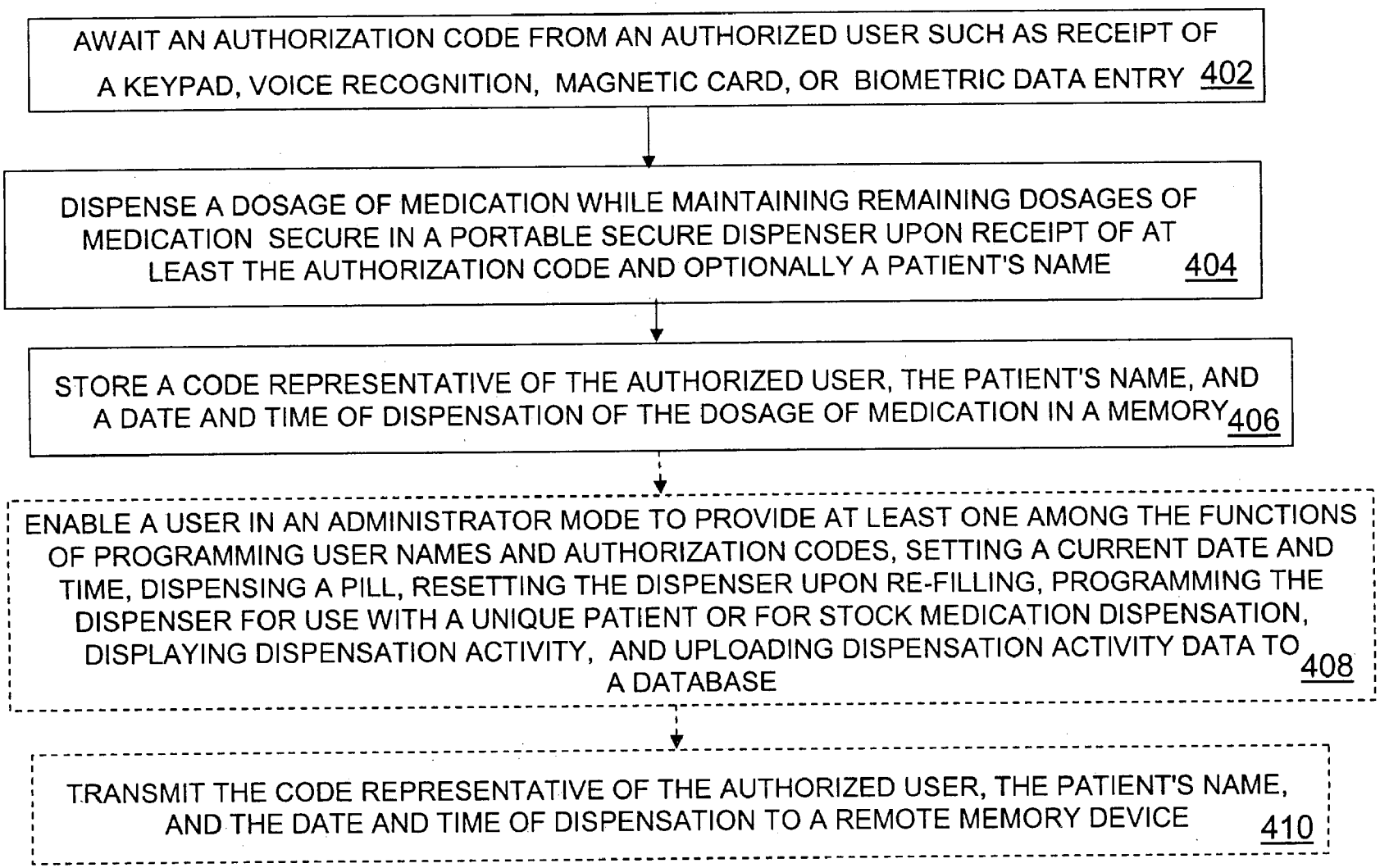
FIG. 4 is a flow chart illustrating a method in accordance with the present invention.

Referring to FIG. 4, a flow chart illustrating a method 400 in accordance with the present invention is shown. The method 400 of dispensing medication from a portable secure dispenser comprises the steps of awaiting 402 an authorization code from an authorized user among a plurality of authorized users, dispensing 404 a dosage of medication while maintaining remaining dosages of medication secure in the portable secure dispenser upon receipt of at least the authorization code and optionally a patient's name, and storing 406 a code representative of the authorized user, a code representative of the patient's name, and a date and time of dispensation of the dosage of medication in a memory. The method may further optionally include the step of enabling 408 a user in an administrator mode to provide at least one among the functions of programming user names and authorization codes, setting a current date and time, dispensing a pill, resetting the dispenser upon re-filling the dispenser with a new dosage of solid medication, programming the dispenser for use with a unique patient or for stock medication dispensation, displaying dispensation activity for a given authorized user for a given patient, and uploading dispensation activity data to a database on a computer. The method 400 may also include the step of transmitting 410 the code representative of the authorized user, representative of the patient's name, and the date and time of dispensation to a remote memory device.

More particularly, as explained above, the users (operators) of this apparatus are the nursing staff and care providers, and not the patient although a patient can be authorized to self dispense if necessary. There is ideally one (1) supervisory user name and PIN, and multiple staff or user names and PIN codes assigned by the supervisor. In one embodiment, each time a staff or user enters their PIN, they are prompted to enter the patient's name. Then, a pill is preferably dispensed with the user's name, the patient's name, and the date and time of dispensation (and other particulars such as type of pill and quantity) stored in the MCU's non-volatile memory. The supervisor or administrator would have more accessibility to the apparatus than the staff user.

Among other tasks, the administrator or supervisor can perform the following tasks:

1. Program user names and PIN,
2. Set the time and date,
3. Dispense a pill,
4. Reset the machine at the time of re-filling with a new medicine card,
5. Display, on the LCD, all pill activity giving the patient's name, operator's name, time and date of each pill dispensed, and
6. Upload the dispensation activity to a computer for record keeping.

After each pill dispensation, the linear drive motors (12 and 19) that are mounted perpendicular to each other, can move the hopper carrying the third actuator motor (13) to the next pill position. The third motor can drive the plunger actuator to push the pill out of the bubble pack when instructed by the user.

Of course, the description of the embodiments described above are merely exemplary and should not limit the scope of the invention. For example, the mechanism for dispensing can take many forms including a fixed plunger and a means of moving the bubble pack or a plunger that moves vertically and a means for moving the bubble pack in one direction, exposing a row of spent bubbles at a time outside the device as illustrated in FIG. 3. Some alternatives may be impractical, but generally servo motors commonly used in RC model airplanes can be used as the linear motors or actuators. Other alternatives such as a solenoid or a car door lock actuator may be either too big or require too much energy. Even a grid of movable slats placed over the bubble card where the many slats are moved to expose only one pill at a time to be pushed by the user would likely need many actuators and a larger area for all the slat movements The description above is intended by way of example only and is not intended to limit the present invention in any way except as set forth in the following claims.

What is claimed is:

1. A medication dispensing system, comprising:

a portable securable container having or holding at least a bubble pack;

a mechanism having a pair of linear drive motors assisting movement along bars perpendicularly aligned to each other for placing an actuator motor adjacent to a single bubble pack and dispensing a dosage of solid medication contained within the single bubble pack of a matrix of bubble packs;

a processor interfacing with the mechanism and further programmed to:

await an authorization code from an authorized user among a plurality of authorized users;

dispense a dosage of medication while maintaining remaining dosages of medication secure in the portable secure dispenser upon receipt of at least the authorization code and optionally a patient's name; and store a code representative of the authorized user and at least one among a code representative of the patient's name and a time of dispensation of the dosage of medication in a memory.

2. The system of claim 1, wherein the processor is further programmed to allow a user in an administrator mode to provide at least one among the functions of programming user names and authorization codes, setting a current date and time, dispensing a pill, resetting the system upon re-filling the system with a new dosage of solid medication, displaying dispensation activity for a given authorized user or a given patient, programming the system for a unique patient or for stock medication dispensation, and upload dispensation activity data to a database on a computer.

3. The system of claim 1, wherein the actuator motor further comprises a plunger that pushes the dosage of solid medication out of the single bubble pack at the instruction of the authorized user.

4. The system of claim 1, wherein the system further comprises a keypad and a liquid crystal display coupled to the processor.

5. The system of claim 1, wherein the system further comprises an easily accessible drawer for retrieving the dosage of solid medication once it has been dispensed.

6. The system of claim 1, wherein the system further comprises a means of biometric data entry associated with an authorized user.

7. The system of claim 1, wherein the code representative of the authorized user is the name of the authorized user and the code representative of the patient's name is the patient's name or social security number, wherein the authorized user is someone other than the patient.

8. The system of claim 1, wherein the code representative of the authorized user is a Personal Identification Number of the authorized user and the code representative of the patient's name is the patient's name or a social security number.

9. The system of claim 1, wherein the system further comprises a transmitter function for transmitting dispensation data to a remote memory device, wherein dispensation data comprises at least one among the code representative of the authorized user, the code representative of the patient's name, and the date and time of dispensation of the dosage of medication.

10. The system of claim 9, wherein the system further comprises a receiver for receiving updated dispensation data for at least one among a particular user and a particular medication.

* * * * *